US012635777B1

(12) United States Patent
Garey et al.

(10) Patent No.: US 12,635,777 B1
(45) Date of Patent: May 26, 2026

(54) SCALP APPLICATOR

(71) Applicants: Colleen Garey, Sanford, FL (US); Keesha Morgan, Sanford, FL (US)

(72) Inventors: Colleen Garey, Sanford, FL (US); Keesha Morgan, Sanford, FL (US)

( * ) Notice: Subject to any disclaimer, the term of this patent is extended or adjusted under 35 U.S.C. 154(b) by 571 days.

(21) Appl. No.: 18/115,067

(22) Filed: Feb. 28, 2023

Related U.S. Application Data

(63) Continuation-in-part of application No. 17/164,894, filed on Feb. 2, 2021, now Pat. No. 11,707,125.

(51) Int. Cl.
*A45D 24/28* (2006.01)
*A45D 19/02* (2006.01)
*A45D 34/04* (2006.01)

(52) U.S. Cl.
CPC ..... *A45D 24/28* (2013.01); *A45D 19/026* (2021.01); *A45D 34/04* (2013.01)

(58) Field of Classification Search
CPC ..... A45D 24/28; A45D 19/026; A45D 2034/005; A45D 34/042; A45D 24/26
See application file for complete search history.

(56) References Cited

U.S. PATENT DOCUMENTS 1,407,230 A * 2/1922 Spielberger ..... A45D 24/28 132/114
2,761,459 A * 9/1956 Kaul ..... A45D 19/026 132/109
3,477,447 A 11/1969 Eldredge
4,213,473 A 7/1980 Dawson
4,294,270 A * 10/1981 Cochran ..... A45D 24/22 132/112
5,054,504 A 10/1991 Winrow
5,311,887 A 5/1994 Ramsey
5,333,627 A * 8/1994 Mehringer ..... A45D 40/262 401/179
5,913,314 A 6/1999 Garrett
6,035,806 A 3/2000 Lorenzo
D450,884 S 11/2001 Yoshida
7,568,486 B2 * 8/2009 Vrus ..... B05C 17/00516 132/208
10,271,627 B1 * 4/2019 Calvo ..... A46B 11/001
12,029,300 B1 * 7/2024 Calvo ..... A45D 24/22
(Continued)

FOREIGN PATENT DOCUMENTS

EP 1002477 5/2000

*Primary Examiner* — Nicholas D Lucchesi
(74) *Attorney, Agent, or Firm* — Kyle A. Fletcher, Esq.

(57) ABSTRACT

The scalp applicator includes a distribution manifold, a housing structure, a discharge structure, and a lotion tube. The distribution manifold and the discharge structure form the working element of the tool formed by the scalp applicator. The housing structure forms the handle of the tool formed by the scalp applicator. The distribution manifold attaches to the housing structure. The discharge structure attaches to the housing structure. The lotion tube inserts into the interior of the housing structure. The lotion tube contains a cosmetic media in a liquid phase. The lotion tube is a flexible structure. The lotion tube forms a fluidic connection with the distribution manifold. The discharge structure applies a pressure to the lotion tube. The applied pressure generates the motive forces required to transport the cosmetic media through the distribution manifold into the hair of a client.

13 Claims, 10 Drawing Sheets

(56) References Cited

U.S. PATENT DOCUMENTS

| | | | | |
|---|---|---|---|---|
| 2005/0199254 | A1* | 9/2005 | Kang | A45D 24/28<br>222/137 |
| 2006/0021629 | A1* | 2/2006 | Mu | A45D 24/22<br>132/116 |
| 2009/0101159 | A1* | 4/2009 | Bonnafous | A45D 19/024<br>132/270 |
| 2013/0048003 | A1* | 2/2013 | Antons | A45D 24/28<br>132/116 |
| 2014/0153996 | A1* | 6/2014 | Ammerman | A45D 34/041<br>401/219 |
| 2014/0251363 | A1* | 9/2014 | Wagner | A46B 11/001<br>132/202 |

* cited by examiner

SCALP APPLICATOR

CROSS REFERENCES TO RELATED APPLICATIONS

This non-provisional application claims priority under 35 USC 120 to U.S. non-provisional application Ser. No. 17/164,894 filed on Feb. 2, 2021 by the inventor: Colleen Garey. This non-provisional application claims U.S. non-provisional application Ser. No. 17/164,894 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of hair care equipment and scalp therapy, more specifically, a scalp applicator.

Background

This application claim priority to U.S. non-provisional application Ser. No. 17/164,894 filed on Feb. 2, 2021 by the inventor: Colleen Garey (hereinafter referred to as the prior disclosure). A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure is configured for use with a cosmetic media. The prior disclosure is a tool. The tool comprises a working element and a handle. The handle forms a reservoir that contains the cosmetic media in a liquid phase. The working element is a fluid transport mechanism (referred to as the applicator comb 200) that transports the liquid phase cosmetic media to a client using the prior disclosure. The working element forms a fluidic connection with the reservoir. The working element transports the liquid phase cosmetic media through multiple tubular structures referred to as the plurality of teeth 211. The plurality of teeth 211 rotate relative to the handle. The plurality of teeth 211 are combed through the hair of the client as the liquid phase cosmetic media is applied to the hair of the client.

SUMMARY OF INVENTION

The scalp applicator of the current disclosure is a tool. The scalp applicator comprises a distribution manifold, a housing structure, a discharge structure, and a lotion tube. The distribution manifold and the discharge structure form the working element of the tool formed by the scalp applicator. The housing structure forms the handle of the tool formed by the scalp applicator. The distribution manifold attaches to the housing structure. The discharge structure attaches to the housing structure. The lotion tube inserts into the interior of the housing structure. The lotion tube contains a cosmetic media in a liquid phase. The lotion tube is a flexible structure. The lotion tube forms a fluidic connection with the distribution manifold. The discharge structure applies a pressure to the lotion tube. The applied pressure generates the motive forces required to transport the cosmetic media through the distribution manifold into the hair of a client.

These together with additional objects, features and advantages of the scalp applicator will be readily apparent to those of ordinary skill in the art upon reading the following detailed description of the presently preferred, but nonetheless illustrative, embodiments when taken in conjunction with the accompanying drawings.

In this respect, before explaining the current embodiments of the scalp applicator in detail, it is to be understood that the scalp applicator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the scalp applicator.

It is therefore important that the claims be regarded as including such equivalent construction insofar as they do not depart from the spirit and scope of the scalp applicator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
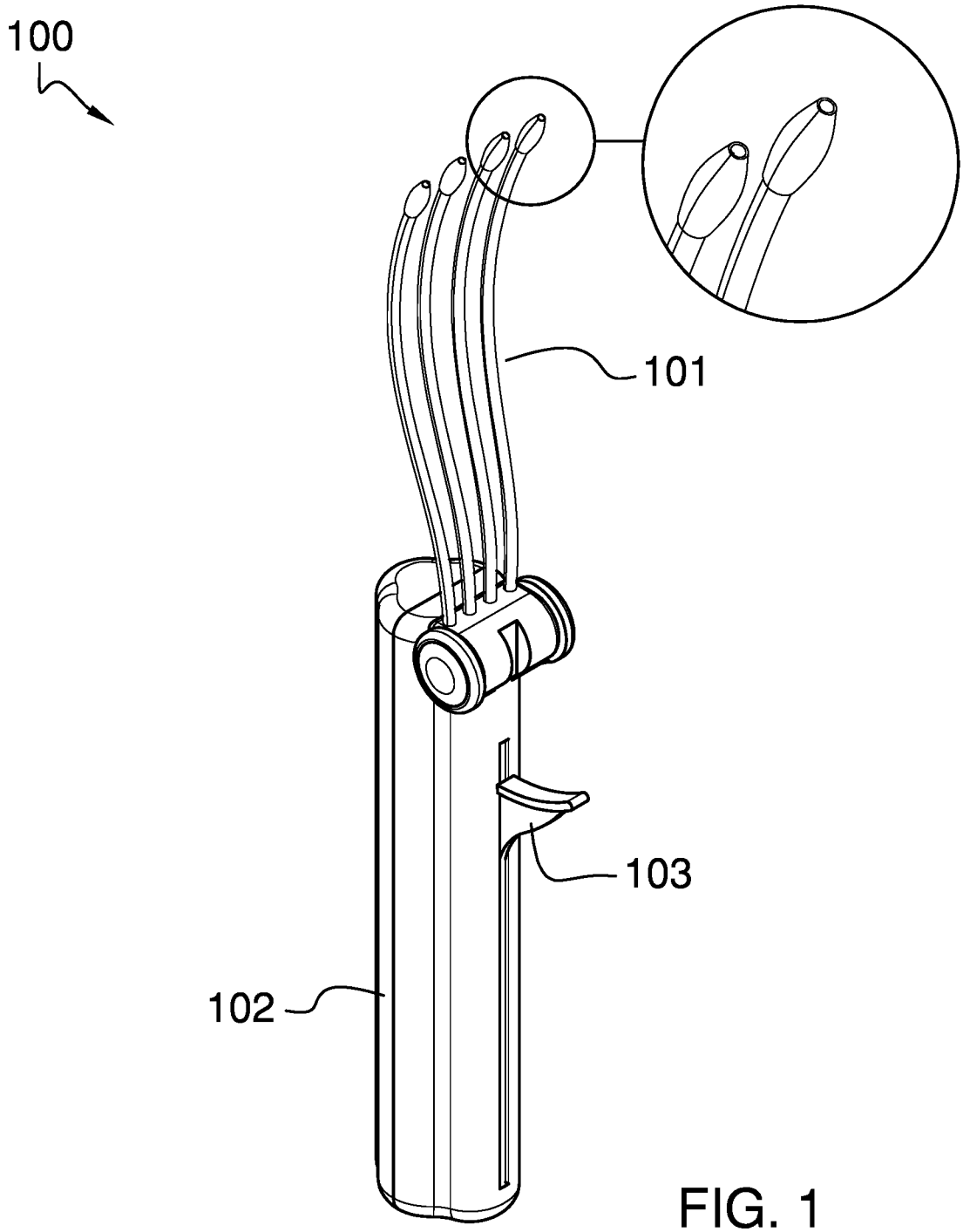
FIG. 1 is a perspective view of an embodiment of the disclosure.
Figure 2:
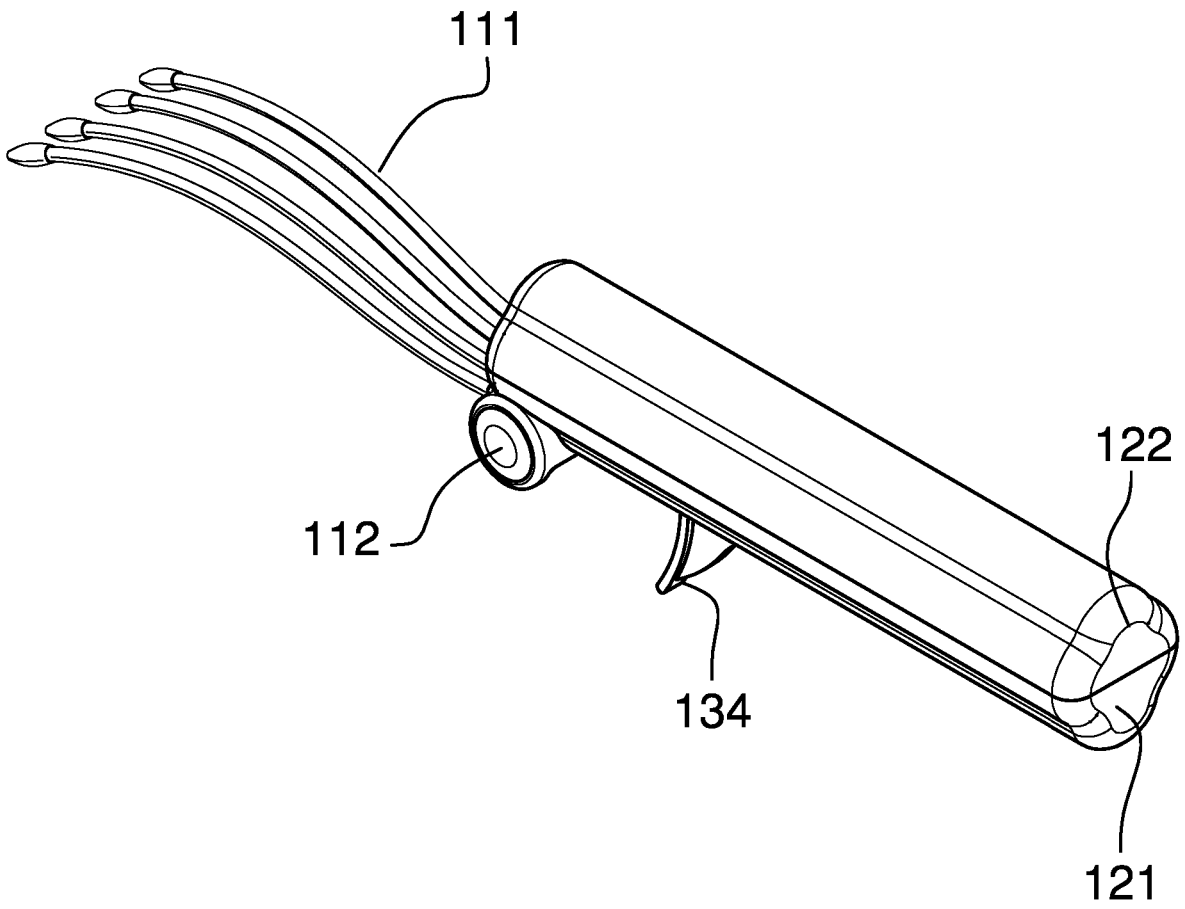
FIG. 2 is a perspective view of an embodiment of the disclosure.
Figure 3:
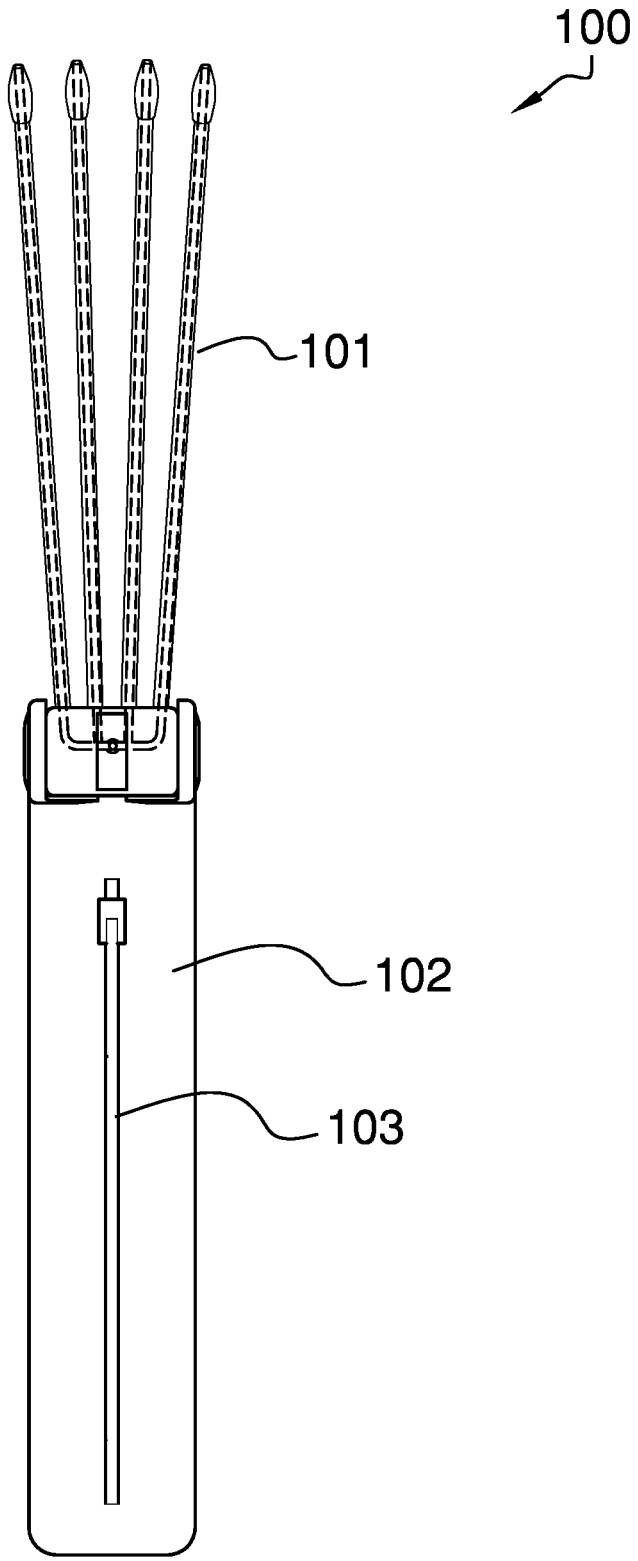
FIG. 3 is a front view of an embodiment of the disclosure.
Figure 4:
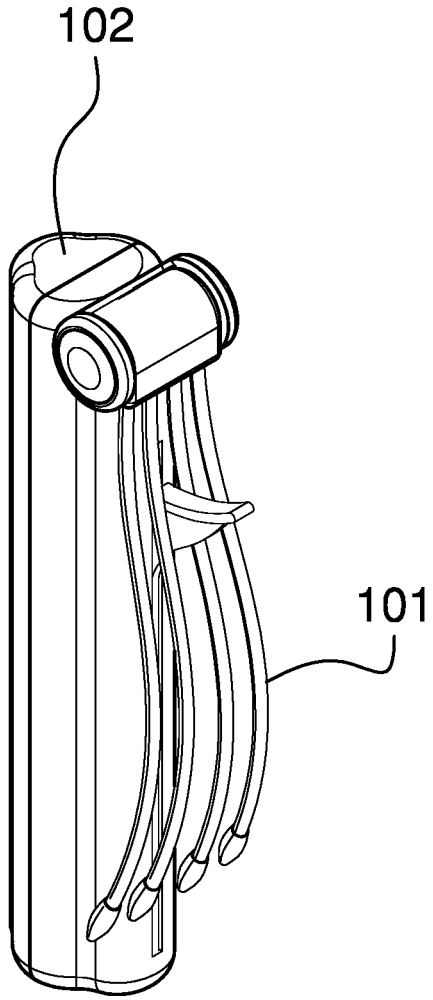
FIG. 4 is a perspective view of an embodiment of the disclosure.
Figure 5:
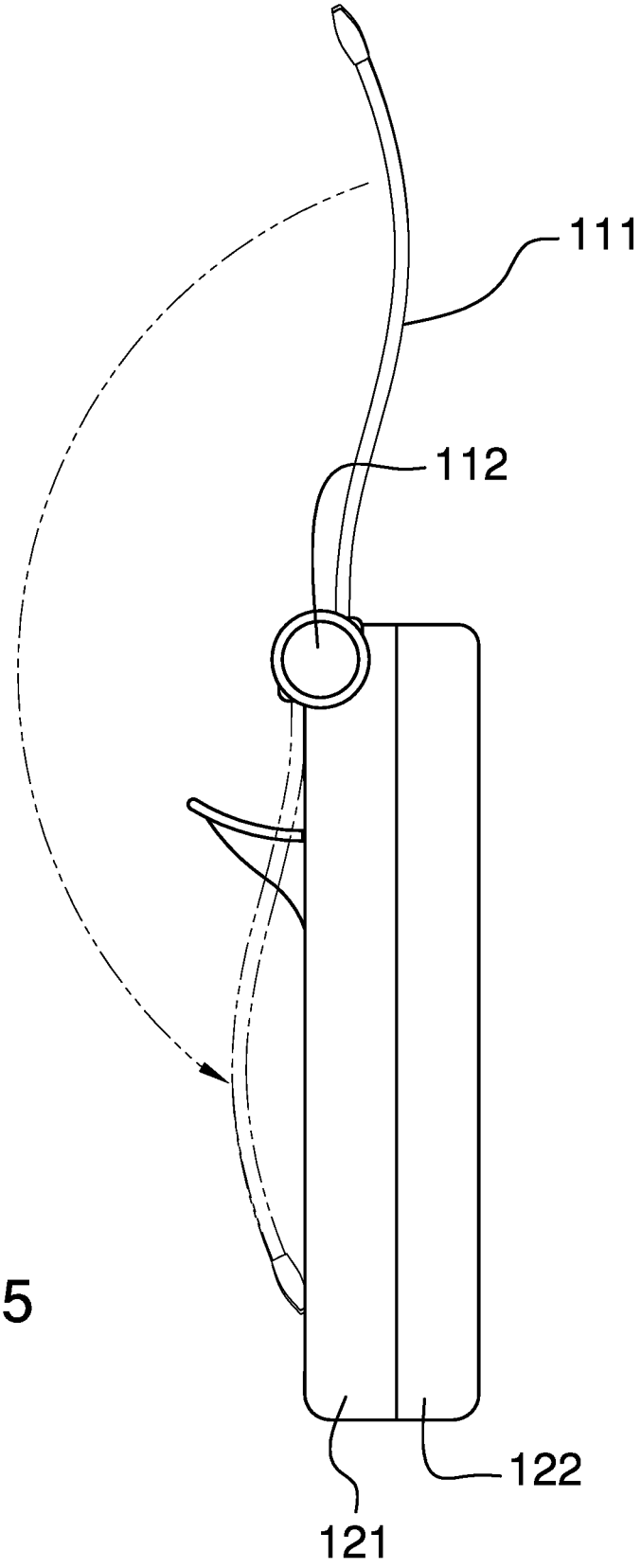
FIG. 5 is a side view of an embodiment of the disclosure.
Figure 6:
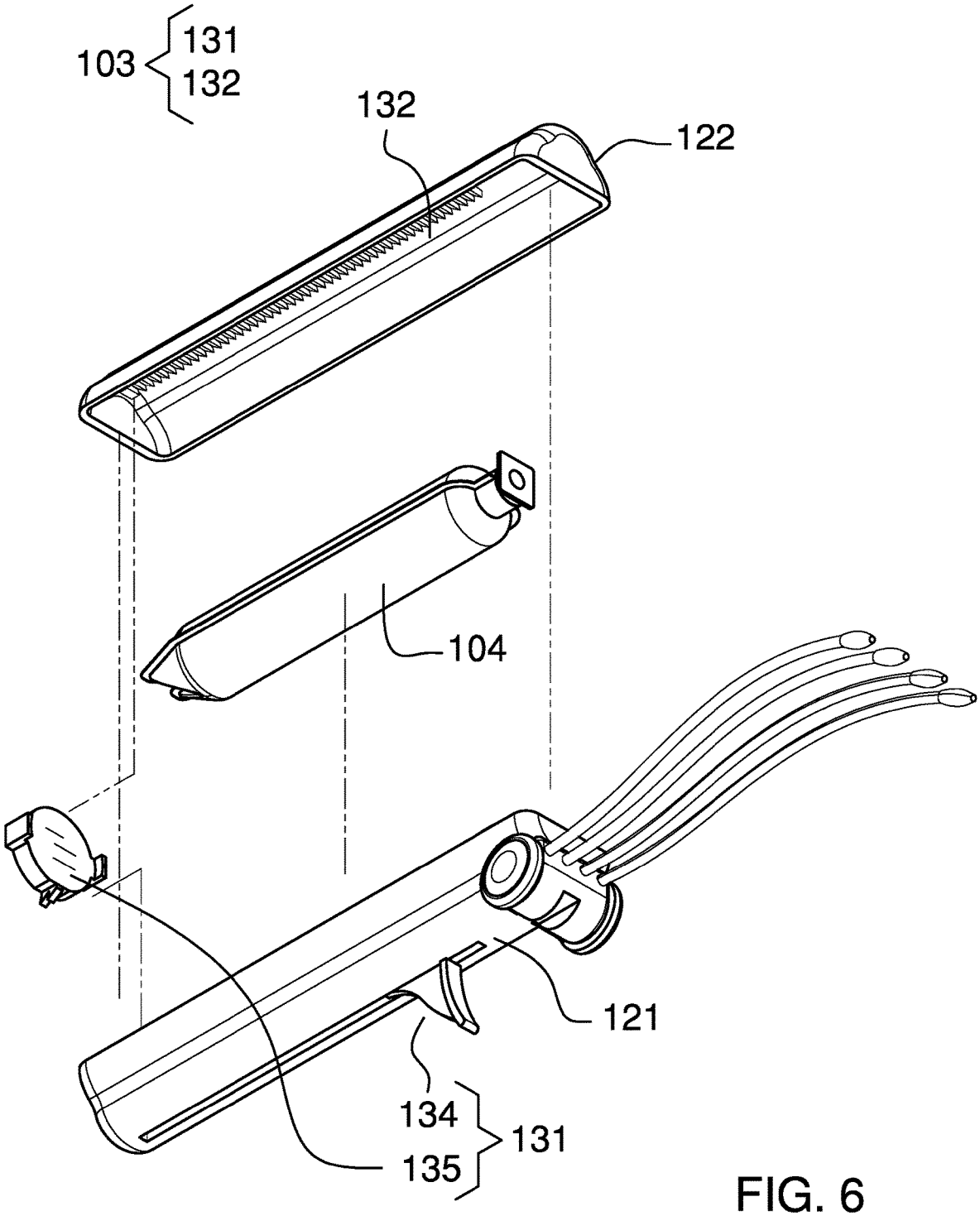
FIG. 6 is an exploded view of an embodiment of the disclosure.
Figure 7:
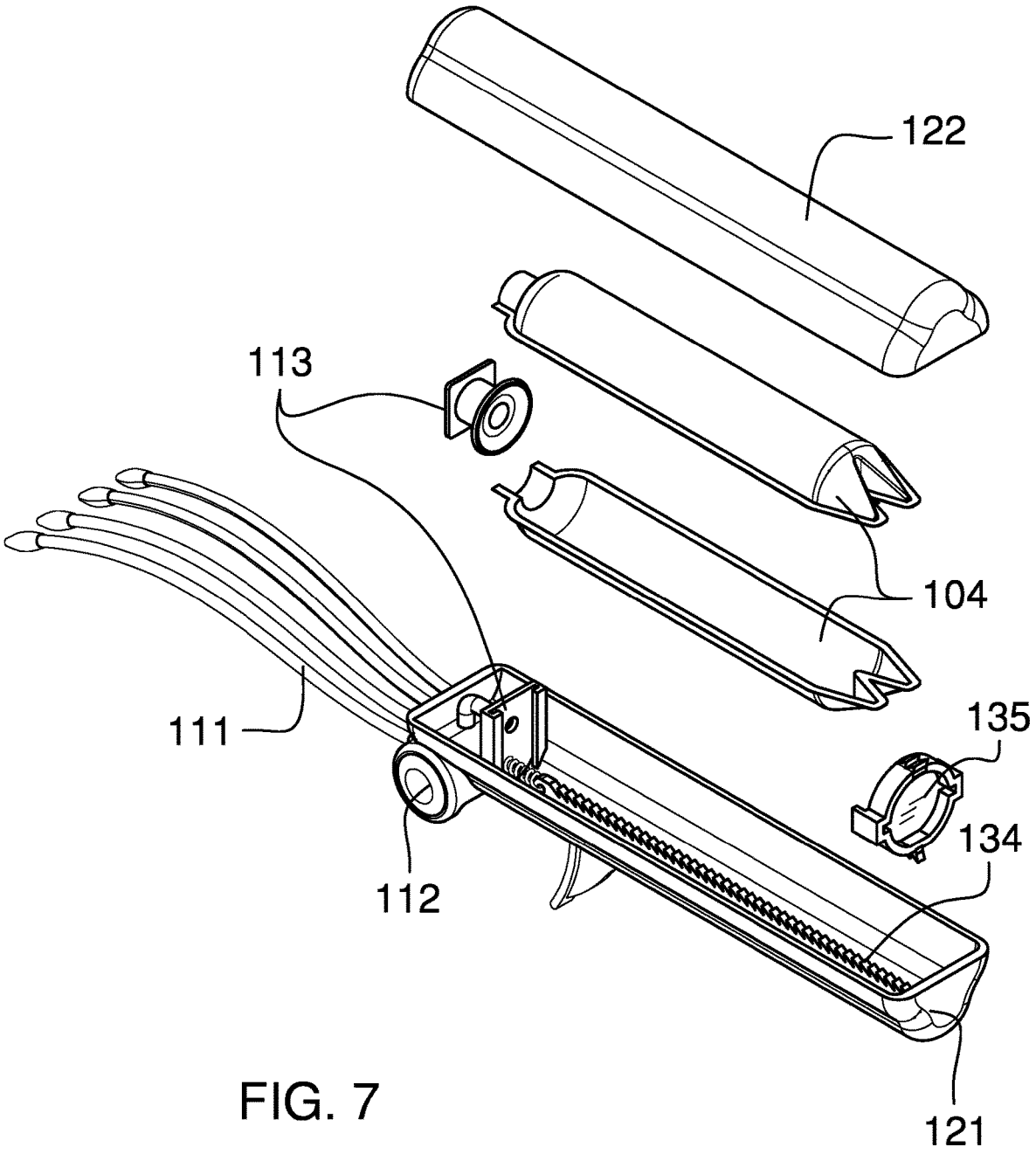
FIG. 7 is an exploded view of an embodiment of the disclosure.
Figure 8:
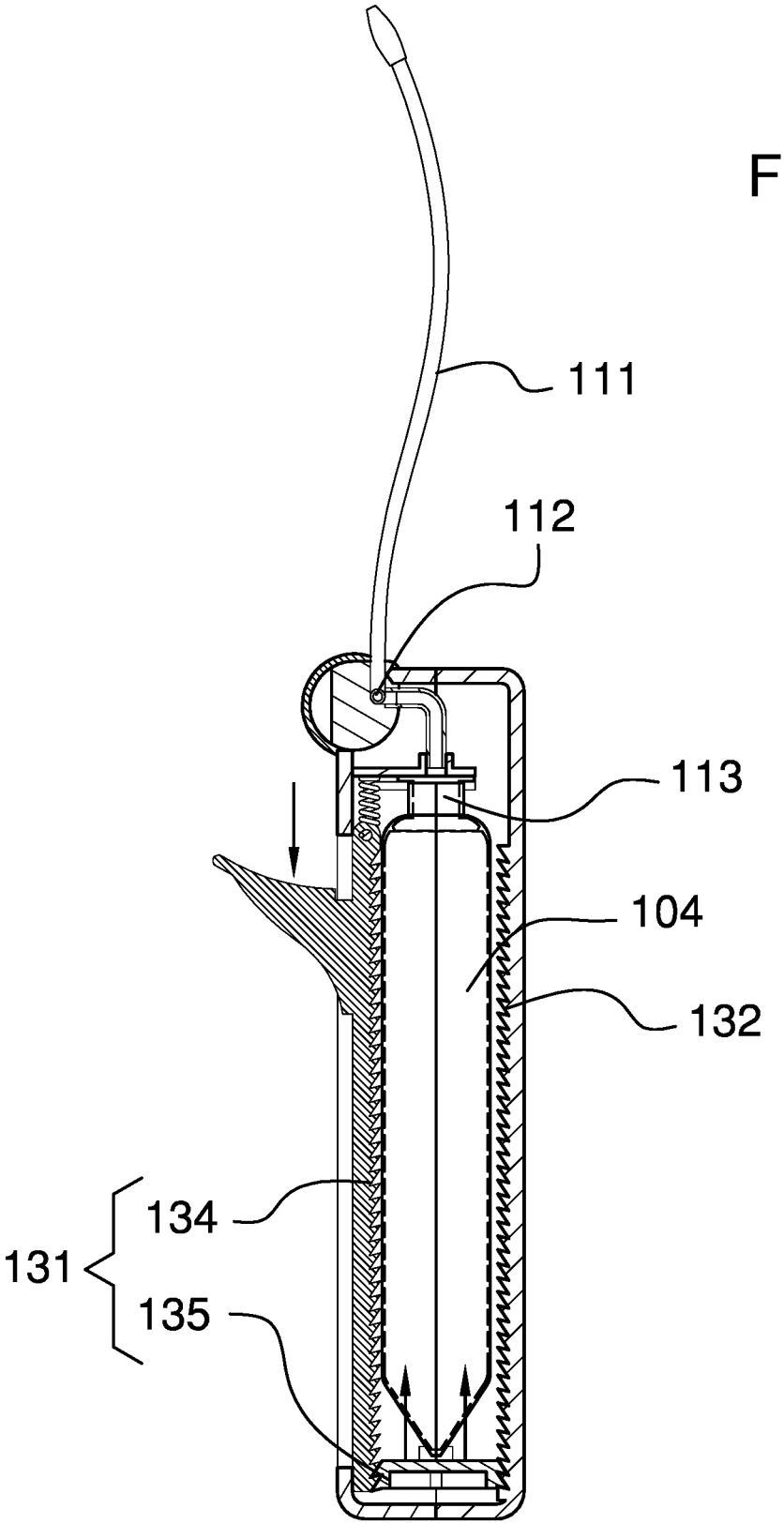
FIG. 8 is a cross-sectional view of an embodiment of the disclosure.
Figure 9:
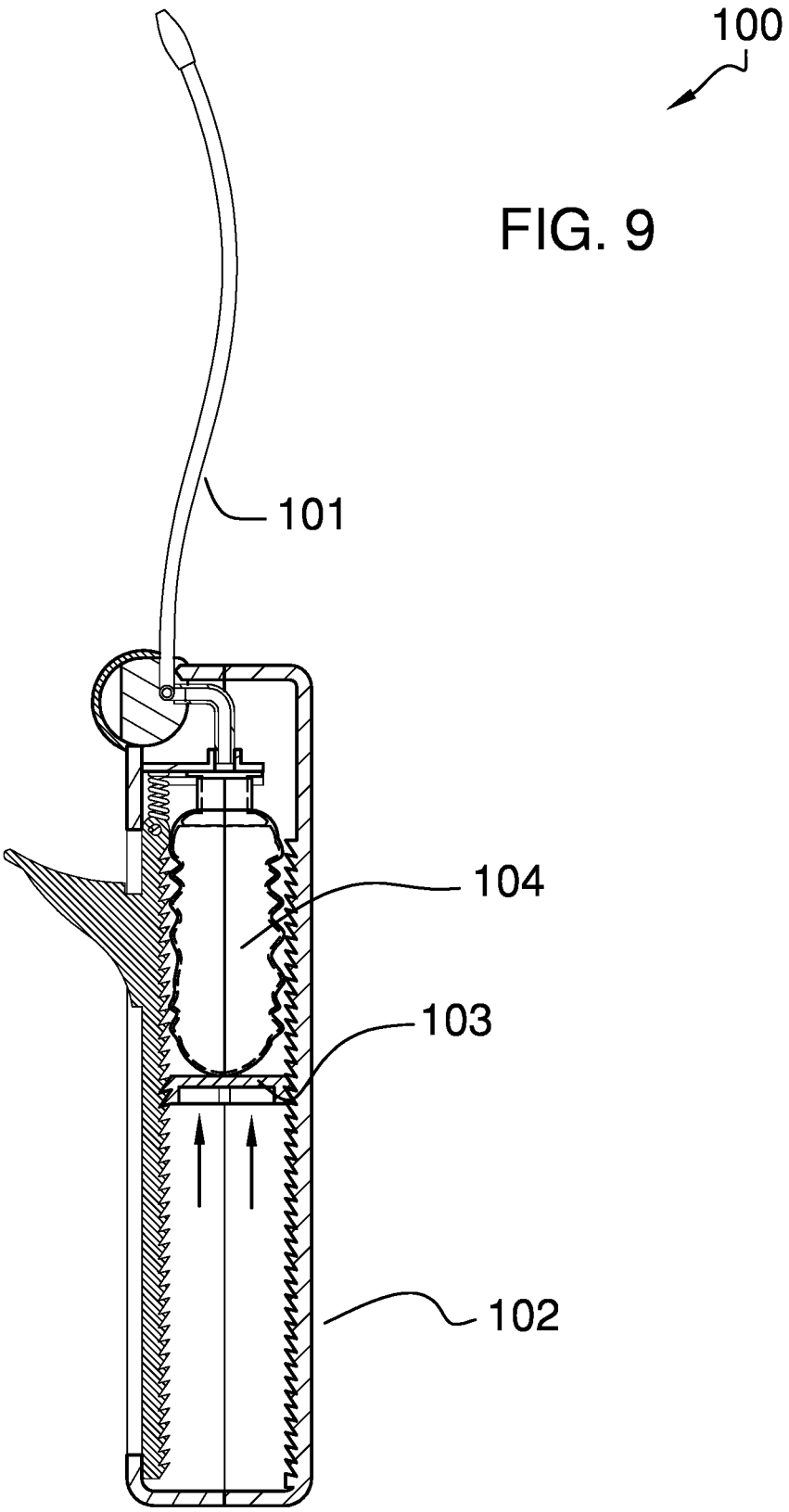
FIG. 9 is a cross-sectional view of an embodiment of the disclosure.
Figure 10:
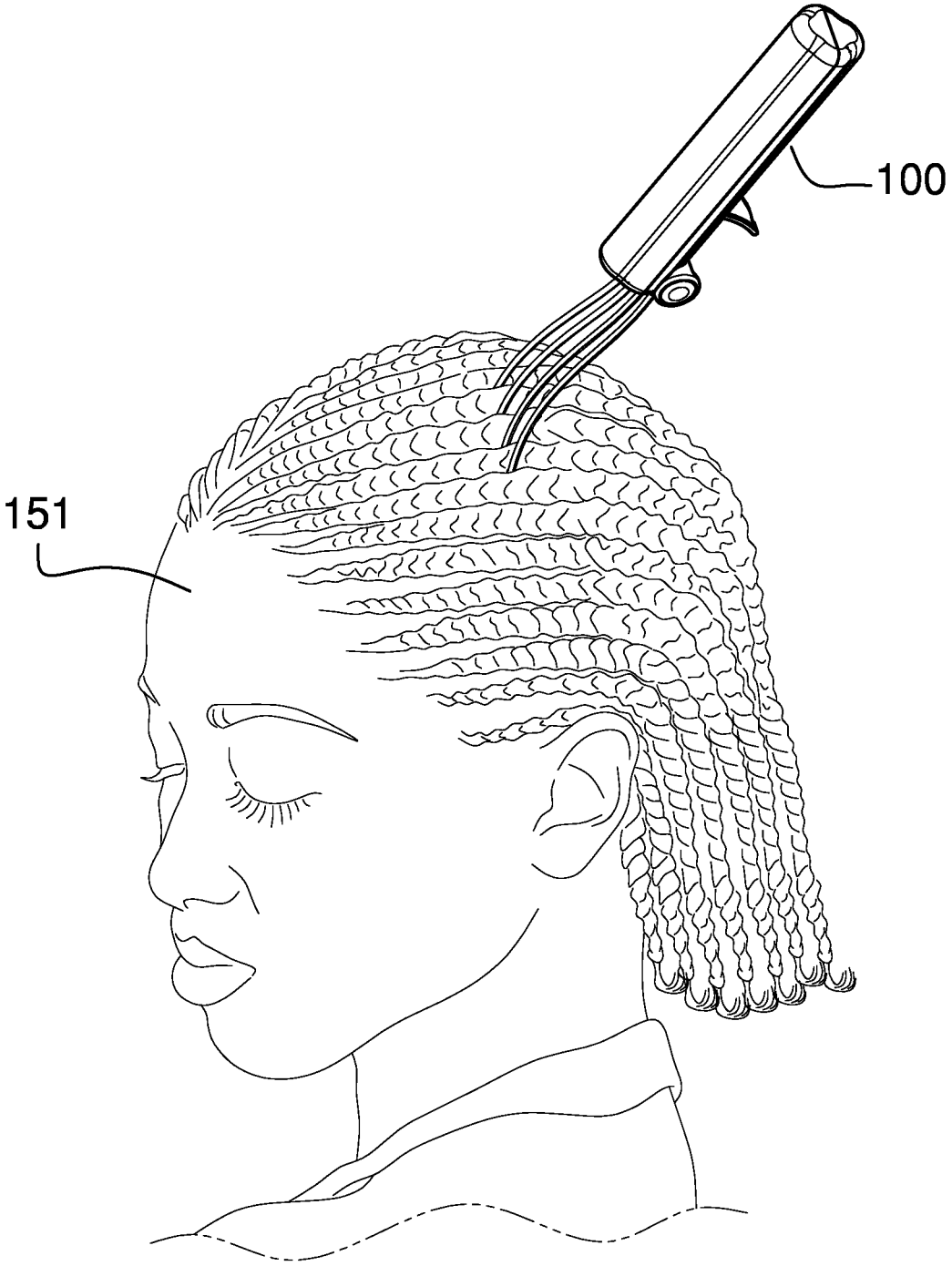
FIG. 10 is an in-use view of an embodiment of the disclosure.

Detailed reference will now be made to one or more potential embodiments of the disclosure, which are illustrated in FIGS. 1 through 10.

The scalp applicator 100 (hereinafter invention) of the current disclosure is a tool. The invention 100 comprises a distribution manifold 101, a housing structure 102, a discharge structure 103, and a lotion tube 104. The distribution manifold 101 and the discharge structure 103 forms the working element of the tool formed by the invention 100. The housing structure 102 forms the handle of the tool formed by the invention 100. The distribution manifold 101 attaches to the housing structure 102. The discharge structure 103 attaches to the housing structure 102. The lotion tube 104 inserts into the interior of the housing structure 102. The lotion tube 104 contains a cosmetic media in a liquid phase. The lotion tube 104 is a flexible structure. The lotion tube 104 forms a fluidic connection with the distribution manifold 101. The discharge structure 103 applies a pressure to the lotion tube 104. The applied pressure generates the motive forces required to transport the cosmetic media through the distribution manifold 101 into the hair of a client 151.

The lotion tube 104 is a fluid containment device. The lotion tube 104 is a fluid impermeable structure. The lotion tube 104 is a hollow structure. The lotion tube 104 has a capped tube structure. The lotion tube 104 forms a protected space that contains a liquid phase cosmetic media.

The lotion tube 104 is a flexible structure such that the lotion tube 104 deforms when pressure is applied to the lotion tube 104. By flexible is meant that the lotion tube 104 deforms when a pressure is applied to the lotion tube 104. The discharge structure 103 applies a pressure against the exterior surface of the lotion tube 104. When a pressure is applied to the exterior surface of the lotion tube 104, the lotion tube 104 deforms such that the containment volume of the lotion tube 104. The decrease of the containment volume of the lotion tube 104 provides the motive forces to drive the liquid phase cosmetic media contained in the lotion tube 104 out of the open end of the capped tube structure of the lotion tube 104.

The lotion tube 104 is a replaceable structure. By replaceable is meant that a first lotion tube 104 can be removed and replaced by a second lotion tube 104 as desired.

The housing structure 102 is a prism shaped structure. The housing structure 102 is a hollow structure. The housing structure 102 forms a protected space that contains the lotion tube 104. The lotion tube 104 inserts into the housing structure 102 such that the lotion tube 104 is subsequently replaceable. The housing structure 102 comprises a first prismatic bifurcation 121 and a second prismatic bifurcation 122.

The first prismatic bifurcation 121 is a prismatic bifurcation of the prism structure of the housing structure 102. The second prismatic bifurcation 122 is a prismatic bifurcation of the prism structure of the housing structure 102. The prismatic bifurcation is defined elsewhere in this disclosure. The second prismatic bifurcation 122 removably attaches to the first prismatic bifurcation 121 to form the protected space formed by the housing structure 102. The second prismatic bifurcation 122 separates from the first prismatic bifurcation 121 to provide access into the hollow interior of the housing structure 102.

The distribution manifold 101 is a fluid transport device. The distribution manifold 101 forms a fluidic connection with the lotion tube 104. The distribution manifold 101 receives the liquid phase cosmetic media under pressure from the lotion tube 104. The distribution manifold 101 transports the liquid phase cosmetic media from the housing structure 102 to the hair of the client 151. The distribution manifold 101 is a rotating structure. The distribution manifold 101 rotates between a closed position and an open position. The client 151 rotates the distribution manifold 101 into the open position for use. The client 151 rotates the distribution manifold 101 into the closed position for storage. The distribution manifold 101 comprises a plurality of teeth 111, a hinge structure 112, and a manifold fitting 113.

The plurality of teeth 111 are assembled to form a comb structure. The plurality of teeth 111 are brushed through the hair of the client 151. The plurality of teeth 111 forms the fluid transport structure of the distribution manifold 101. Each tooth selected from the plurality of teeth 111 forms a tubular structure. Each tooth selected from the plurality of teeth 111 forms a fluid transport path that transports fluid received from the manifold fitting 113 into the hair of the client 151.

The hinge structure 112 is a fastening device. The hinge structure 112 is a rotating structure. The hinge structure 112 attaches the plurality of teeth 111 to the housing structure 102 such that the plurality of teeth 111 rotates relative to the housing structure 102. The plurality of teeth 111 rotates between the closed position and the open position.

The manifold fitting 113 is a fitting. The manifold fitting 113 forms a fluidic connection between the lotion tube 104 and the plurality of teeth 111. The manifold fitting 113 transports the liquid phase cosmetic media contained in the lotion tube 104 into the plurality of teeth 111.

The discharge structure 103 is a mechanical structure. The discharge structure 103 forms physical contact with the lotion tube 104. The discharge structure 103 applies a pressure against the lotion tube 104 that provides the motive forces that discharges the liquid phase cosmetic media contained in the lotion tube 104 into the manifold fitting 113 of the distribution manifold 101. The pressure applied by the discharge structure 103 provides the motive forces necessary to transport the liquid phase cosmetic media through the plurality of teeth 111 into the hair of the client 151. The discharge structure 103 comprises a worm drive structure 131 and a ratchet structure 132.

The worm drive structure 131 is a mechanical structure. The worm drive is defined elsewhere in this disclosure. The worm drive structure 131 is the structure of the discharge structure 103 that applies the external pressure that deforms the lotion tube 104. The worm drive structure 131 further comprises a drive structure 134 and a pusher plate 135.

The pusher plate 135 is a disk shaped structure. The pusher plate 135 mounts in the hollow interior of the prism structure of the housing structure 102. The center axis of the disk structure of the pusher plate 135 aligns with the center axis of the prism structure of the housing structure 102. The drive structure 134 moves in the direction parallel to the center axis of the housing structure 102. The pusher plate 135 is the structure of the worm drive structure 131 that forms physical contact with the lotion tube 104. The drive structure 134 drives the pusher plate 135 the in the direction of the manifold fitting 113 of the distribution manifold 101 such that the drive structure 134 provides an external pressure against the lotion tube 104 that provides the motive forces that discharge the liquid phase cosmetic media contained in the lotion tube 104 into the manifold fitting 113 of the distribution manifold 101.

The drive structure 134 is the mechanical structure. The drive structure 134 generates the motive forces that are used by the worm drive structure 131 to move the pusher plate 135 within the housing structure 102. In the first potential embodiment of the disclosure, the drive structure 134 is a manually operated structure.

The ratchet structure 132 is a mechanical structure. The ratchet is defined elsewhere in this disclosure. The ratchet structure 132 forms a mechanical structure that limits the motion of the worm drive 131 within the housing structure 102 to a single direction.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barrier: As used in this disclosure, a barrier is a physical obstacle that forms a boundary between a first space and a second space. The barrier prevents the passage of an object between the first space and the second space.

Cant: As used in this disclosure, a cant is an angular deviation from one or more reference lines (or planes) such as a vertical line (or plane) or a horizontal line (or plane).

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Client: As used in this disclosure, a client is an individual who is designated to receive the services of the disclosure at bar.

Closed Position: As used in this disclosure, a closed position refers to a movable structure that is in an orientation that minimizes the perimetrical boundary presented by the movable structure. The closed position is often referred to as an object being "closed."

Comb: As used in this disclosure, a comb is a toothed device that is used for detangling or otherwise arranging hair. The comb comprises a base structure from which project a plurality of teeth. Each of the plurality of teeth is a rod that projects away from the base structure. The hair is placed in the diastema between each pair of adjacent teeth selected from the plurality of teeth.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Container: As used in this disclosure, a container is a structure that forms a protected space (or protection space) used to store and transport an object. The term containment structure is a synonym for container. Use protected space or protection space.

Correspond: As used in this disclosure, the term correspond is used as a comparison between two or more objects wherein one or more properties shared by the two or more objects match, agree, or align within acceptable manufacturing tolerances.

Cosmetic: As used in this disclosure, cosmetic is an adjective that refers to a substance, a process, a procedure, or a device that is intended to improve the appearance of an individual or biological entity. By substance is meant a chemical compound such as a cosmetic media or pharmacologically active media. A cosmetic specialist is an individual who is designated to provide cosmetic services to a client.

Cosmetic Media: As used in this disclosure, a cosmetic media refers to a chemical substance that is topically applied to a biological organism. The purposes for a cosmetic media include, but are not limited to: a) cleaning the skin and the hair of the biological organism; b) changing the visual, olfactory, and tactile stimuli presented by the biological organism to other nearby biological organisms; and, c) the topical application of a pharmacologically active media.

Diastema: As used in this disclosure, a diastema is the space between two teeth.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space.

Fitting: As used in this disclosure, a fitting is a component that attaches a first object to a second object. The fitting is used to form a fluidic connection between the first object and the second object.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Gel: As used in this disclosure, a gel is a substance comprising mostly of liquid (by mass) that is trapped in a cross-linked network structure that exhibits the properties of both a solid and a liquid.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Hair: As used in this disclosure, hair refers to the fibrous keratin-based structure commonly seen growing from the skin of mammals.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Interchangeable: As used in this disclosure, interchangeable refers to the ability to remove and replace an element of a structure. For example, if a first object that is attached to a structure can be removed and replaced with a second object selected from a plurality of compatible objects than the first object is said to be replaceable with both: 1) the second object; and, 2) each of the elements of compatible objects. Term interchangeable is commonly associated with tools. Interchangeable objects are often used to change the function or the performance characteristics of a tool.

Interior: As used in this disclosure, the interior is used as a relational term that implies that an object is contained within the boundary of a structure or a space.

Lever: As used in this disclosure, a lever is a device that comprises a shaft that rotates around a fulcrum, axis of rotation, or pivot point. Levers are known for generating a mechanical advantage, known as leverage, when they are used to provide rotational force into a rotating mechanical system or device. A lever is an example of a simple machine.

Lotion: As used in this disclosure, a lotion is a smooth viscous liquid that is used for medical, hygienic, or cosmetic purposes. Lotions are commonly used as a delivery device for applying a pharmacologically active media such as an antibiotic ointment, a surfactant such as a soap, a skin moisturizer.

Negative Space: As used in this disclosure, negative space is a method of defining an object through the use of open or empty space as the definition of the object itself, or, through the use of open or empty space to describe the boundaries of an object.

Liquid: As used in this disclosure, a liquid refers to a state (phase) of matter that is fluid and that maintains, for a given pressure, a fixed volume that is independent of the volume of the container.

Mechanical Advantage: As used in this disclosure, mechanical advantage is a measure of the ratio of the force generated by a mechanical device divided by force applied to the mechanical device. The leverage generated by a lever is an example of mechanical advantage. Typically, a mechanical advantage will amplify the force input into the mechanical device but does not impact the energy transfers through the mechanical device.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable structure that is in an orientation that presents a perimetrical boundary of the movable structure that is greater than the closed position. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pawl: As used in this disclosure, a pawl is a rotating bar or lever with a free end that engages a toothed structure.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Pivot: As used in this disclosure, a pivot is a rod or shaft around which an object rotates or swings.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Prismatic Bifurcation: As used in this disclosure, a prismatic bifurcation refers to the bifurcation of a prism structure by a plane wherein the bifurcating plane is does not intersect the center axis of the prism structure. In a prismatic bifurcation, the center axis can lie on the bifurcating plane. In this instance, the prismatic bifurcation is said to form a horizontal segment.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Ratchet: As used in this disclosure, a ratchet is a device comprising a pawl or hinged catch that engages the sloping teeth of a wheel or bar permitting motion in one direction only.

Relaxed Shape: As used in this disclosure, a structure is considered to be in its relaxed state when no shear, strain, or torsional forces are being applied to the structure.

Rotation: As used in this disclosure, rotation refers to the cyclic movement of an object around a fixed point or fixed axis. The verb of rotation is to rotate.

Solid: As used in this disclosure, a solid refers to a state (phase) of matter that: 1) has a fixed volume; and, 2) does not flow.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tool: As used in this disclosure, a tool is a device, an apparatus, or an instrument that is used to carry out an activity, operation, or procedure. A tool generally comprises a working element and a handle. The handle of a tool that forms a sub-component of a larger structure is referred to as a mount.

Topical: As used in this disclosure, topical is an adjective that is associated with cosmetic and pharmacologically active media. Topical indicates that the cosmetic and pharmacologically active media are applied directly to the skin.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Viscosity: As used in this disclosure, viscosity refers to the resistance of a liquid or an elastic material to deformation. Higher viscosity would refer to a greater resistance to flow or to deformation. The term centipoise refers to the units of measurement of viscosity in a liquid. In this disclosure: a) a viscosity of greater that 80 centipoise is considered a high viscosity; and, b) a viscosity of greater than 2000 centipoise is considered a gel like viscosity.

Viscous: As used in this disclosure, a viscous material is a material with a viscosity such that the viscous material has characteristics intermediate between a liquid and a solid.

Working Element: As used in this disclosure, the working element of a tool is the physical element on the tool that performs the actual activity, operation, or procedure the tool is designed to perform. For example, the cutting edge of a blade is the working element of a knife.

Worm Drive: As used in this disclosure, a worm drive refers to a mechanical arrangement where a rotating cylinder further comprising an exterior screw thread is used to: 1) rotate a gear; or 2) move a plate formed with an interior screw thread in a linear fashion in the direction of the center axis of the rotating cylinder. Worm drives are also referred to as worm gears.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A scalp applicator comprising a distribution manifold, a housing structure, a discharge structure, and a lotion tube;

wherein the distribution manifold and the discharge structure forms the working element of a tool formed by the scalp applicator;

wherein the housing structure forms the handle of the tool formed by the scalp applicator;

wherein the lotion tube inserts into the interior of the housing structure;

wherein the distribution manifold attaches to the housing structure;

wherein the discharge structure attaches to the housing structure;

wherein the lotion tube is a flexible structure such that the lotion tube deforms when pressure is applied to the lotion tube;

wherein the distribution manifold is a fluid transport device that forms a fluidic connection with the lotion tube;

wherein the distribution manifold receives a liquid phase cosmetic media under pressure from the lotion tube;

wherein the distribution manifold is adapted to transport the liquid phase cosmetic media from the housing structure to a hair of a client;

wherein the distribution manifold is a rotating structure;

wherein the distribution manifold rotates between a closed position and an open position.

2. The scalp applicator according to claim 1 wherein the lotion tube is a fluid containment device;

wherein the lotion tube is a fluid impermeable structure;

wherein the lotion tube is a hollow structure;

wherein the lotion tube has a capped tube structure;

wherein the lotion tube is a flexible structure;

wherein the discharge structure applies a pressure to the lotion tube;

wherein the applied pressure is adapted to generate the motive forces required to transport the cosmetic media through the distribution manifold into the hair of the client;

wherein the lotion tube forms a protected space that contains the liquid phase cosmetic media.

3. The scalp applicator according to claim 2 wherein the discharge structure applies a pressure against the exterior surface of the lotion tube;

wherein when a pressure is applied to the exterior surface of the lotion tube, the lotion tube deforms such that the containment volume of the lotion tube is decreased;

wherein a decrease of the containment volume of the lotion tube provides motive forces to drive the liquid phase cosmetic media contained in the lotion tube out of the capped tube structure of the lotion tube;

wherein the lotion tube is a replaceable structure;

wherein by replaceable is meant that a first lotion tube can be removed and replaced by a second lotion tube as desired.

4. The scalp applicator according to claim 3 wherein the housing structure is a prism shaped structure;

wherein the housing structure is a hollow structure;

wherein the housing structure forms a protected space that contains the lotion tube;

wherein the lotion tube inserts into the housing structure such that the lotion tube is subsequently replaceable.

5. The scalp applicator according to claim 4 wherein the discharge structure is a mechanical structure;

wherein the discharge structure forms physical contact with the lotion tube;

wherein the discharge structure applies a pressure against the lotion tube that provides the motive forces that discharges the liquid phase cosmetic media contained in the lotion tube into a manifold fitting of the distribution manifold;

wherein the pressure applied by the discharge structure provides the motive forces necessary to transport the liquid phase cosmetic media through a plurality of teeth into the hair of the client.

6. The scalp applicator according to claim 5 wherein the housing structure comprises a first prismatic bifurcation and a second prismatic bifurcation;

wherein the first prismatic bifurcation is a prismatic bifurcation of the prism shaped structure of the housing structure;

wherein the second prismatic bifurcation is a prismatic bifurcation of the prism shaped structure of the housing structure;

wherein the second prismatic bifurcation removably attaches to the first prismatic bifurcation to form the protected space formed by the housing structure;

wherein the second prismatic bifurcation separates from the first prismatic bifurcation to provide access into a hollow interior of the housing structure.

7. The scalp applicator according to claim 6 wherein the distribution manifold comprises a plurality of teeth, a hinge structure, and the manifold fitting;

wherein the plurality of teeth forms a fluid transport structure of the distribution manifold;

wherein the hinge structure attaches the plurality of teeth to the housing structure;

wherein the manifold fitting forms a fluidic connection between the lotion tube and the plurality of teeth.

8. The scalp applicator according to claim 7 wherein the discharge structure comprises a worm drive structure and a ratchet structure;

wherein the ratchet structure forms a mechanical structure that limits the motion of the worm drive within the housing structure to a single direction.

9. The scalp applicator according to claim 8 wherein the plurality of teeth are assembled to form a comb structure;

wherein the plurality of teeth are brushed through the hair of the client;

wherein each tooth selected from the plurality of teeth forms a tubular structure;

wherein each tooth selected from the plurality of teeth forms a fluid transport path that transports fluid received from the manifold fitting into the hair of the client.

10. The scalp applicator according to claim 9 wherein the hinge structure is a fastening device;

wherein the hinge structure is a rotating structure;

wherein the hinge structure attaches the plurality of teeth to the housing structure such that the plurality of teeth rotates relative to the housing structure;

wherein the plurality of teeth rotates between the closed position and the open position.

11. The scalp applicator according to claim 10 wherein the manifold fitting transports the liquid phase cosmetic media contained in the lotion tube into the plurality of teeth.

12. The scalp applicator according to claim 11 wherein the worm drive structure is a mechanical structure;

wherein the worm drive structure is the structure of the discharge structure that applies the external pressure that deforms the lotion tube.

13. The scalp applicator according to claim 11 wherein the worm drive structure further comprises a drive structure and a pusher plate;

wherein the drive structure drives the pusher plate;

wherein the pusher plate is a disk shaped structure;

wherein the pusher plate mounts in the hollow interior of the prism shaped structure of the housing structure;

wherein the center axis of the disk structure of the pusher plate aligns with the center axis of the prism shaped structure of the housing structure;

wherein the drive structure moves in the direction parallel to the center axis of the housing structure;

wherein the pusher plate is the structure of the worm drive structure that forms physical contact with the lotion tube;

wherein the pusher plate drives the drive structure in the direction of the manifold fitting of the distribution manifold such that the drive structure provides an external pressure against the lotion tube that provides the motive forces that discharge the liquid phase cosmetic media contained in the lotion tube into the manifold fitting of the distribution manifold;

wherein the drive structure generates the motive forces that are used by the worm drive structure to move the pusher plate within the housing structure.

* * * * *